US005686401A

United States Patent [19]

Willey et al.

[11] Patent Number: 5,686,401

[45] Date of Patent: Nov. 11, 1997

[54] BLEACHING COMPOUNDS COMPRISING N-ACYL CAPROLACTAM FOR USE IN HAND-WASH OR OTHER LOW-WATER CLEANING SYSTEMS

[75] Inventors: Alan David Willey, Cincinnati; Michael Eugene Burns, West Chester; Jerome Howard Collins, Cincinnati, all of Ohio

[73] Assignee: The Procter & Gamble Company, Cincinnati, Ohio

[21] Appl. No.: 486,655

[22] Filed: Jun. 7, 1995

Related U.S. Application Data

[62] Division of Ser. No. 433,177, May 3, 1995, which is a continuation of Ser. No. 64,623, May 20, 1993, abandoned.

[51] Int. Cl.[6] ..... D06L 3/02; C11D 3/39; C11D 3/395

[52] U.S. Cl. ..... 510/313; 510/376; 510/378; 8/111; 8/137

[58] Field of Search ..... 8/111, 137; 252/102, 252/186.39; 510/292, 313, 376, 378

[56] References Cited

U.S. PATENT DOCUMENTS

| | | | |
|---|---|---|---|
| 3,177,148 | 4/1965 | Bright | 252/99 |
| 4,013,575 | 3/1977 | Castrantas | 252/104 |
| 4,207,199 | 6/1980 | Perner | 252/99 |
| 4,412,934 | 11/1983 | Chung | 252/186.38 |
| 4,444,674 | 4/1984 | Gray | 252/102 |
| 4,545,784 | 10/1985 | Sanderson | 8/107 |

*Primary Examiner*—Margaret Einsmann

*Attorney, Agent, or Firm*—Michael D. Jones; Brian M. Bolam; Kim W. Zerby

[57] ABSTRACT

The present invention relates to a method of cleaning fabrics with heavy soil loads or by hand-washing with detergent compositions comprising N-acyl caprolactam bleaching activators.

5 Claims, No Drawings

BLEACHING COMPOUNDS COMPRISING N-ACYL CAPROLACTAM FOR USE IN HAND-WASH OR OTHER LOW-WATER CLEANING SYSTEMS

This is a division of application Ser. No. 08/433,177, filed on May 3, 1995, which is a continuation of application Ser. No. 08/064,623, filed on May 20, 1993 now abandoned.

FIELD OF THE INVENTION

The present invention relates to laundry detergents with activated bleaching systems which are effective under heavy soil load conditions, especially under consumer usage habits which involve hand-washing rather than conventional machine laundering.

BACKGROUND OF THE INVENTION

It has long been known that peroxygen bleaches are effective for stain and/or soil removal from fabrics, but that such bleaches are temperature dependent. At a laundry liquor temperature of 60° C., peroxygen bleaches are only partially effective. As the laundry liquor temperature is lowered below 60° C., peroxygen bleaches become relatively ineffective. As a consequence, there has been a substantial amount of industrial research to develop bleaching systems which contain an activator that renders peroxygen bleaches effective at laundry liquor temperatures below 60° C. However, relatively little work seems to have been specifically directed to bleaching systems which can be used in hand-wash laundering operations, even though such hand-washing is typically carried out at temperatures below 60° C.

Numerous substances have been disclosed in the art as effective bleach activators. One widely-used bleach activator is tetraacetyl ethylene diamine (TAED). TAED provides effective hydrophilic cleaning especially on beverage stains, but has limited performance on dingy stains and body soils. Another type of activator, such as nonanoyloxybenzenesulfonate (NOBS) and other activators which generally comprise long chain alkyl moieties, is hydrophobic in nature and provides excellent performance on dingy stains. However, many of the hydrophobic activators developed thus far have now been found to be rather ineffective in cleaning heavy soil loads, particularly nucleophilic soils and body soils. Such heavy soil conditions are typically found in laundering situations wherein the ratio of water:fabric load is substantially less than in conventional automatic laundry machines. This is especially true under hand-wash conditions, but also occurs in concentrated washing processes, such as those disclosed in U.S. Pat. Nos. 4,489,455 and 4,489,574, both issued to Spendel on Dec. 25, 1984. Under such circumstances, conventional activators, such as NOBS, appear to interact with, and be destroyed by, the heavy soil loads before they can provide their intended bleaching function. Whatever the reason for the decreased performance, the selection of detergent-added bleaching systems, useful under conditions with heavy soil loads and under usage conditions which involve low water:fabric ratios, has been limited. A need, therefore, exists for a bleaching system which performs efficiently and effectively under such heavy soil load conditions.

By the present invention, it has now been discovered that the class of bleach activators derived from N-acyl caprolactams performs very well in cleaning heavy soil loads, especially nucleophilic and body soils. Accordingly, the present invention solves the long-standing need for a bleaching system which performs efficiently and effectively under heavy soil loads, low water: fabric ratios and low temperatures, particularly under conditions typically encountered with hand-washing operations. The bleaching systems and activators herein afford additional advantages in that, unexpectedly, they are safer to fabrics and cause less color damage than other activators when used in the manner provided by this invention.

BACKGROUND ART

U.S. Pat. No. 4,545,784, Sanderson, issued Oct. 8, 1985, discloses the adsorption of activators onto sodium perborate monohydrate.

SUMMARY OF THE INVENTION

The present invention relates to a method for cleaning fabrics under heavy soil load conditions, i.e., at low ratios of wash water:soiled fabrics. Said method comprises contacting said fabrics in an aqueous liquor comprising a detergent composition which comprises conventional detergent ingredients and a bleaching system which comprises:

a) at least about 0.1%, preferably from about 1% to about 75%, by weight, of a peroxygen bleaching compound capable of yielding hydrogen peroxide in an aqueous solution; and b) at least about 0.1%, preferably from about 0.1% to about 50%, by weight, of one or more N-acyl caprolactam bleach activators.

The preferred acyl moieties of said N-acyl caprolactam bleach activators have the formula $R^1$—CO— wherein $R^1$ is H or an alkyl, aryl, alkaryl, or alkoxyaryl group containing from 1 to 12 carbon atoms, preferably from 6 to 12 carbon atoms. In highly preferred embodiments, $R^1$ is a member selected from the group consisting of phenyl, heptyl, octyl, nonyl, decenyl and 2,4,4-trimethylpentyl substituents.

The N-acyl caprolactam activators herein can also be used in combination with non-caprolactam activators such as TAED, typically at weight ratios of caprolactam:TAED in the range of 1:5 to 5:1, preferably about 1:1.

The peroxygen bleaching compound can be any peroxide source and is preferably a member selected from the group consisting of sodium perborate monohydrate, sodium perborate tetrahydrate, sodium pyrophosphate peroxyhydrate, urea peroxyhydrate, sodium percarbonate, sodium peroxide and mixtures thereof. Highly preferred peroxygen bleaching compounds are selected from the group consisting of sodium perborate monohydrate, sodium perborate tetrahydrate, sodium percarbonate and mixtures thereof. The most highly preferred peroxygen bleaching compound is sodium percarbonate.

The invention also encompasses laundry compositions in bar form which comprise the aforesaid bleaching system together with detersive ingredients which are present in the bar at the levels indicated hereinafter.

The bleaching method herein is preferably conducted with agitation of the fabrics with an aqueous liquor containing the aforesaid compositions at levels from about 50 ppm to about 27,500 ppm, and is especially adapted for hand-washing wherein the fabrics are soiled with nucleophilic and body soils. The method can be carried out at any desired washing temperature, even at temperatures below about 60° C., and is readily conducted at typical hand-wash temperatures in the range of from about 5° C. to about 45° C. The hand-wash method can be conducted conveniently using a composition which is in bar form, but can also be conducted using granules, flakes, powders, pastes, and the like.

The aqueous laundry liquor typically comprises at least about 300 ppm of conventional detergent ingredients, as well as at least about 25 ppm of the bleaching compound and at least about 25 ppm of the bleach activator. Preferably, the liquor comprises from about 900 ppm to about 20,000 ppm of conventional detergent ingredients, from about 100 ppm to about 25,000 ppm of the bleaching compound and from about 100 ppm to about 2,500 ppm of the bleach activator. The conventional detergent ingredients and bleaching system will typically be combined into a detergent composition such as a granular laundry detergent or, preferably, laundry detergent bar.

The conventional detergent ingredients employed in said method and in the bars and other compositions herein comprise from about 1% to about 99.8%, preferably from about 5% to about 80%, of a detersive surfactant. Optionally, the detergent ingredients comprise from about 5% to about 80% of a detergent builder. Other optional detersive adjuncts can also be included in such compositions at conventional usage levels.

All percentages, ratios, and proportions herein are by weight, unless otherwise specified. All documents cited are incorporated herein by reference.

DETAILED DESCRIPTION OF THE INVENTION

The bleaching system employed in the present invention provides effective and efficient surface bleaching of fabrics which thereby removes stains and/or soils from the fabrics. The bleaching system is particularly efficient at cleaning heavy soil loads, especially those associated with nucleophilic and body soils. Body soils are those soils that result in the fabric coming in contact with the body. These include lipid and protein soils. Nucleophilic soils are soils that interact with and destroy certain bleach activators, such as amine-containing and alcohol-containing soils.

Heavy soil loads are typically encountered with low water to fabric load laundering usage. Under heavy soil loads conditions, the ratio of fabric:water (kg:liters) ranges from about 1:10 to about 1:0.5, especially about 1:7 to about 1:1. A typical ratio under hand-wash conditions is about 1:5. Additionally, under hand-wash conditions the fabrics typically contain high amounts of body and nucleophilic soils which have accumulated on the fabrics from repeated and/or prolonged usage between washing.

Without wishing to be limited by theory, it is believed that bleach activators comprising an ester moiety, such as nonanoyloxy-benzenesulfonate (NOBS), may react prematurely with nucleophilic and body soils and are thereby prevented from undergoing perhydrolysis with the peroxygen to form a bleaching agent. The bleach activators employed herein do not contain ester moieties and are, therefore, resistant to nucleophilic attack from the soils. In effect, the bleach activators employed herein are more selective to perhydrolysis reactions than bleach activators such as NOBS.

The bleaching mechanism and, in particular, the surface bleaching mechanism are not completely understood. However, it is generally believed that the bleach activator undergoes nucleophilic attack by a perhydroxide anion, which is generated from the hydrogen peroxide evolved by the peroxygen bleaching compound, to form a peroxycarboxylic acid. This reaction is commonly referred to as perhydrolysis. It is also believed, that the bleach activators within the invention can render peroxygen bleaches more efficient even at laundry liquor temperatures wherein bleach activators are not necessary to activate the bleach, i.e., above about 60° C. Therefore, with bleach systems of the invention, less peroxygen bleach is required to achieve the same level of surface bleaching performance as is obtained with the peroxygen bleach alone.

The components of the bleaching system herein comprise the bleach activator and the peroxide source, as described hereinafter.

Bleach Activators

The bleach activators employed in the present invention are N-acyl caprolactams of the formula:

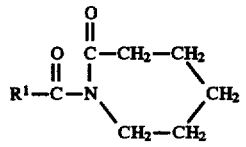

wherein $R^1$ is H or an alkyl, aryl, alkaryl, or alkoxyaryl group containing from 1 to 12 carbons. Caprolactam activators wherein the $R^1$ moiety contains at least about 6, preferably from 6 to about 12, carbon atoms provide hydrophobic bleaching which affords nucleophilic and body soil clean-up, as noted above. Caprolactam activators wherein $R^1$ comprises H or from about 1 to about 6 carbon atoms provide hydrophilic bleaching species which are particularly efficient for bleaching beverage stains. Mixtures of hydrophobic and hydrophilic caprolactams, typically at weight ratios of 1:5 to 5:1, preferably 1:1, can be used herein for mixed stain removal benefits.

Highly preferred hydrophobic N-acyl caprolactams are selected from the group consisting of octanoyl caprolactam, nonanoyl caprolactam, decanoyl caprolactam, undecanoyl caprolactam, 3,5,5-tri-methylhexanoyl caprolactam, and mixtures thereof. Highly preferred hydrophilic N-acyl caprolactams are selected from the group consisting of formyl caprolactam, acetyl caprolactam, and propinoyl caprolactam.

Benzoyl caprolactam i.e., wherein $R^1$ is a phenyl substituent, has now been found to be unique among the bleach activator compounds, inasmuch as it appears to exhibit both hydrophobic and hydrophilic bleaching activity. This hydrophobic/hydrophilic bleaching capability makes benzoyl caprolactam the activator of choice for the formulator who is seeking broad spectrum bleaching activity, but wishes to use only a single activator to simplify formulation work.

Methods of making N-acyl caprolactams are well known in the art. Examples I and II, included below, illustrate preferred laboratory syntheses. Contrary to the teachings of U.S. Pat. No. 4,545,784, cited above, the bleach activator is preferably not absorbed onto the peroxygen bleaching compound. To do so in the presence of other organic detersive ingredients could cause safety problems.

The bleaching system comprises at least about 0.1%, preferably from about 0.1% to about 50%, more preferably from about 1% to about 30%, most preferably from about 3% to about 25%, by weight, of one or more N-acyl caprolactam bleach activators.

When the activators are used, optimum surface bleaching performance is obtained with washing solutions wherein the pH of such solution is between about 8.5 and 10.5, preferably between 9.5 and 10.5, in order to facilitate the perhydrolysis reaction. Such pH can be obtained with substances commonly known as buffering agents, which are optional components of the bleaching systems herein.

The Peroxygen Bleaching Compound

The peroxygen bleaching compounds useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxyhydrate, urea peroxyhydrate, sodium peroxide, and sodium percarbonate. Particularly preferred are sodium perborate tetrahydrate, sodium perborate monohydrate and sodium percarbonate. Sodium percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If, coated percarbonate is used, the preferred coating materials include mixtures of carbonate and sulphate, silicate, borosilicate, or fatty carboxylic acids.

The bleaching system comprises at least about 0.1%, preferably from about 1% to about 75%, more preferably from about 3% to about 40%, most preferably from about 3% to about 25%, by weight, of a peroxygen bleaching compound capable of yielding hydrogen peroxide in an aqueous solution.

The weight ratio of bleach activator to peroxygen bleaching compound in the bleaching system typically ranges from about 2:1 to 1:5. In preferred embodiments, the ratio ranges from about 1:1 to about 1:3.

The bleach activator/bleaching compound systems herein are useful per se as bleaches. However, such bleaching systems are especially useful in compositions which can comprise various detersive adjuncts such as surfactants, builders, enzymes, and the like as disclosed hereinafter.

Detersive Surfactant

The amount of detersive surfactant included in the fully-formulated detergent compositions afforded by the present invention can vary from about 1% to about 99.8%, by weight of the detergent ingredients, depending upon the particular surfactants used and the effects desired. Preferably, the detersive surfactants comprise from about 5% to about 80%, by weight of the detergent ingredients.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11-C18}$ alkyl benzene sulfonates and primary, secondary, and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One particular class of adjunct nonionic surfactants especially useful herein comprises the polyhydroxy fatty acid amides of the formula:

$$R^2-\overset{\overset{\displaystyle O}{\|}}{C}-\overset{\overset{\displaystyle R^1}{|}}{N}-Z \qquad \text{(I)}$$

wherein: $R^1$ is H, $C_1$–$C_8$ hydrocarbyl, 2-hydroxyethyl, 2hydroxy-propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive animation reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')-(CHOH)-CH_2OH$, where n is an integer from 1 to 5, inclusive, and R' is H or a cyclic mono- or polysaccharide, and alkoxylated derivatives thereof. Most preferred are glycityls wherein n is 4, particularly $-CH_2-(CHOH)_4-CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If lower sudsing is desired, $R^1$ is preferably $C_2$–$C_8$ alkyl, especially n-propyl., iso-propyl, n-butyl, iso-butyl, pentyl, hexyl and 2-ethyl hexyl.

$R^2-CO-N<$ can be, for example, cocamide, stearamide, oleamide, lauramide, myristamide, capricamide, palmitamide, tallowamide, etc.

Detergent Builders

Optional detergent ingredients employed in the present invention contain inorganic and/or organic detergent builders to assist in mineral hardness control. If used, these builders comprise from about 5% to about 80% by weight of the detergent compositions.

Inorganic detergent builders include, but are not limited to, the alkali metal, ammonium and alkanolammonium salts of polyphosphates (exemplified by the tripolyphosphates, pyrophosphates, and glassy polymeric mete-phosphates), phosphonates, phytic acid, silicates, carbonates (including bicarbonates and sesquicarbonates), sulphates, and aluminosilicates. However, non-phosphate builders are required in some locales.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, available from Hoechst under the trademark "SKS"; SKS-6 is an especially preferred layered silicate builder.

Carbonate builders, especially a finely ground calcium carbonate with surface area greater than 10 $m^2/g$, are preferred builders that can be used in granular compositions. The density of such alkali metal carbonate built detergents can be in the range of 450–850 g/l with the moisture content preferably below 4%. Examples of carbonate builders are the alkaline earth and alkali metal carbonates as disclosed in German Patent Application No. 2,321,001 published on Nov. 15, 1973.

Aluminosilicate builders are especially useful in the present invention. Preferred aluminosilicates are zeolite builders which have the formula:

$$Na_x[(AlO_2)_z(SiO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. Preferably, the aluminosilicate has a particle size of about 0.1–10 microns in diameter.

Organic detergent builders suitable for the purposes of the present invention include, but are not restricted to, a wide variety of polycarboxylate compounds, such as ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TOS" builders of U.S. Pat. No. 4,663,071, issued to Bush et al, on May 5, 1987.

Other useful detergent builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrolotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are preferred polycarboxylate builders that can also be used in granular compositions, especially in combination with zeolite and/or layered silicate builders.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,583; 3,213,030; 3,422,021; 3,400,148 and 3,422,137) can also be used.

Optional Detersive Adjuncts

As a preferred embodiment, the conventional detergent ingredients employed herein can be selected from typical detergent composition components such as detersive surfactants and detergent builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. Adjuncts which can also be included in detergent compositions employed in the present invention, in their conventional art-established levels for use (generally from 0% to about 20% of the detergent ingredients, preferably from about 0.5% to about 10%), include enzymes, especially proteases, lipases and cellulases, color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzyme stabilizing agents, perfumes, solvents, solubilizing agents, clay soil removal/anti-redeposition agents, polymeric dispersing agents, processing aids, fabric softening components static control agents, etc.

Bleach systems optionally, but preferably, will also comprise a chelant which not only enhances bleach stability by scavenging heavy metal ions which tend to decompose bleaches, but also assists in the removal of polyphenolic stains such as tea stains, and the like. Various chelants, including the aminophosphonates, available as DEQUEST from Monsanto, the nitrilotriacetates, the hydroxyethylethylenediamine triacetates, and the like, are known for such use. Preferred biodegradable, non-phosphorus chelants include ethylene-diamine disuccinate ("EDDS"; see U.S. Pat. No. 4,704,233, Hartman and Perkins), ethylenediamine-N,N'-diglutamate (EDDG) and 2-hydroxypropylenediamine-N,N'-disuccinate (HPDDS) compounds. Such chelants can be used in their alkali or alkaline earth metal salts, typically at levels from about 0.1 to about 10 of the present compositions.

Optionally, the detergent compositions employed herein can comprise, in addition to the bleaching system of the present invention, one or more other conventional bleaching agents, activators, or stabilizers which are not rendered ineffective from interaction with the nucleophilic and body soils. In general, the formulator will ensure that the bleach compounds used are compatible with the detergent formulation. Conventional tests, such as tests of bleach activity on storage in the presence of the separate or fully-formulated ingredients, can be used for this purpose.

Specific examples of optional bleach activators for incorporation in this invention include tetraacetyl ethylene diamine (TAED), the benzoxazin-type bleaching activators disclosed in U.S. Pat. No. 4,966,723, Hodge et al, issued Oct. 30, 1990, and the bleach agents and activators disclosed in U.S. Pat. No. 4,634,551, Burns et al, issued Jan. 6, 1987. Such bleaching compounds and agents can be optionally included in detergent compositions in their conventional art-established levels of use, generally from 0% to about 15%, by weight of detergent composition.

Bleaching activators of the invention are especially useful in conventional laundry detergent compositions such as those typically found in granular detergents or laundry bars. U.S. Pat. No. 3,178,370, Okenfuss, issued Apr. 13, 1965, describes laundry detergent bars and processes for making them. Philippine Patent 13,778, Anderson, issued Sep. 23, 1980, describes synthetic detergent laundry bars. Methods for making laundry detergent bars by various extrusion methods are well known in the art.

The following examples are given to further illustrate the present invention, but are not intended to be limiting thereof.

EXAMPLE I

Synthesis of Nonanoyl Caprolactam

To a two liter three necked around bottomed flask equipped with a condenser, overhead stirrer and 250 ml additional funnel is charged 56.6 g (0.5 moles) caprolactam, 55.7 g (0.55 moles) triethylamine and 1 liter of dioxane; the resulting solution is heated to reflux (120° C.). A solution of 88.4 g (0.55 moles) nonanoyl chloride dissolved in 200 ml of dioxane is then added over 30 minutes, and the mixture is refluxed for a further 6 hours. The reaction mixture is then cooled, filtered, and the solvent removed by rotary evaporation to yield 120.5 g of the product as a dark oil. This crude product is then dissolved in diethyl ether, washed with 3×50 ml aliquots of water, dried over magnesium sulphate and the solvent removed by rotary evaporation to yield 81.84 g (65% theoretical yield) of product which is shown by NMR to be 90% pure, with the remaining material being nonanoic acid.

EXAMPLE II

Synthesis of Benzoyl Caprolactam

To a two liter three necked round bottomed flask equipped with a condenser, overhead stirrer and 250 ml additional funnel is charged 68.2 g (0.6 moles) caprolactam, 70 g (0.7 moles) triethylamine and 1 liter of dioxane; the resulting solution is heated to reflux (120° C.). A solution of 84.4 g (0.06 moles) benzoyl chloride dissolved in 200 ml of dioxane is then added over 30 minutes, and the mixture is refluxed for a further 6 hours. The reaction mixture is then cooled, filtered, and the solvent removed by rotary evaporation to yield 121.7 g of the product as an oil which crystallizes on standing. This crude product is then redissolved in toluene and precipitated with hexane, yielding 103 g (79% theoretical yield) of a white solid which which is shown by NMR to be over 95% pure, with the remaining material being benzoic acid.

EXAMPLE III

A granular detergent composition is prepared comprising the following ingredients.

| Component | Weight % |
|---|---|
| $C_{12}$ linear alkyl benzene sulfonate | 22 |
| Phosphate (as sodium tripolyphosphate) | 30 |
| Sodium carbonate | 14 |
| Sodium silicate | 3 |
| Sodium percarbonate* | 5 |
| Ethylenediamine disuccinate chelant (EDDS) | 0.4 |
| Sodium sulfate | 5.5 |
| Nonanoyl caprolactam | 5 |
| Minors, filler** and water | Balance to 100% |

*Average particle size of 400 to 1200 microns.
**Can be selected from convenient materials such as $CaCO_3$, talc, clay, silicates, and the like.

Aqueous crutcher mixes of heat and alkali stable components of the detergent compositions are prepared and spray-dried and the other ingredients are admixed so that they contain the ingredients tabulated at the levels shown.

White 100% cotton fabric, white polycotton fabric (50%/50% T-Shirt material), and an all synthetic material (81% acrylic, 15% nylon, 4% Lycra) are used in the testing. Using a Sears KENNORE washer, the fabrics are desized with a commercial granular detergent (DASH). The washing is conducted in 0 grains per gallon (gpg) water at a temperature of 120° F. of (48.8° C.) for 12 minutes, with subsequent rinsing in 0 gpg water at a temperature of 120° F. (48.8° C.). This desizing step is done twice and is followed by two additional wash cycles using only water. The desized fabrics are formed into swatches (5 inches square).

Testing is done in a 5 pot Automatic Mini-Washer (AMW) to mimic a hand-wash operation using standardized conditions. After the AMW pots are filled with 7.6 liters (2 gallons) of water each, the detergent composition (above) is added to each pot providing a 1,000 ppm concentration of detergent. The clean test swatches are then added with an amount of unwashed, dirty consumer ballast to bring the water/cloth ratio to the desired level. An equivalent amount of unwashed consumer ballast and test swatches are added to a pot containing an identical control formula with the single exception that an equivalent amount of benzoyloxybenzenesulfonate bleach activator is substituted for the nonanoyl caprolactam. The wash cycle is conducted in 8 gpg water at a temperature of 77° F. (25° C.) water. The wash cycle consists of a 30 minute soak followed by 10 minute agitation. After the wash cycle, there is a 2 minute spin cycle, followed by two 2-minute rinse cycles using 8 gpg water at a temperature of 77° F. (25° C.).

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7L^2-40Lb)/700$$

The higher the value for. W, the better the whiteness performance. In the above test, fabrics exposed to the nonanoyl caprolactam bleaching system display significantly improved whiteness after laundering compared with fabrics which have been exposed to the bleaching system with benzoyloxybenzenesulfonate.

EXAMPLE IV

A granular detergent composition is prepared comprising the following ingredients.

| Component | Weight % |
|---|---|
| Anionic alkyl sulfate | 7 |
| Nonionic surfactant | 5 |
| Zeolite (0.1–10 micron) | 10 |
| Citrate | 2 |
| SKS-6 silicate builder | 10 |
| Acrylate maleate polymer | 4 |
| Nonanoyl caprolactam | 5 |
| Sodium percarbonate | 15 |
| Sodium carbonate | 5 |
| Ethylenediamine disuccinate chelant (EDDS) | 0.4 |
| Suds suppressor | 2 |
| Enzymes* | 1.5 |
| Soil release agent | 0.2 |
| Minors, filler** and water | Balance to 100% |

*1:1:1 mixture of protease, lipase, and cellulase.
**Can be selected from convenient materials such as $CaCO_3$, talc, clay, silicates, and the like.

Aqueous crutcher mixes of heat and alkali stable components of the detergent compositions are prepared and spray-dried and the other ingredients are admixed so that they contain the ingredients tabulated at the levels shown.

White 100% cotton fabric, white polycotton fabric (50%/50% T-Shirt material), and an all synthetic material (81% acrylic, 15% nylon, 4% Lycra) are used in the testing. Using a Sears KENMORE washer, the fabrics are desized with a commercial granular detergent (DASH). The washing is conducted in 0 grains per gallon (gpg) water at a temperature of 104° F. (40° C.) for 40 minutes, with subsequent rinsing in 0 gpg water at a temperature of 104° F. (40° C.). This desizing step is done twice and is followed by two additional wash cycles using only water. The desized fabrics are formed into swatches (5 inches square).

Testing is done in a 5 pot Automatic Mini-Washer (AMW) to mimic a hand-wash operation using standardized conditions. After the ANW pots are filled with 7.6 liters (2 gallons) of water each, the detergent composition (above) is added to each pot providing an 8,000 ppm concentration of detergent. The clean test swatches are then added alone with an amount of unwashed, dirty consumer ballast to bring the water/cloth ratio to the desired level. An equivalent amount of unwashed consumer ballast and test swatches are added to a pot containing an identical control formula without bleaching system. The wash cycle is conducted in 15 gpg water at a temperature of 104° F. (40° C.) water. The wash cycle consists of a 30 minute soak followed by 40 minutes of agitation. After the wash cycle, there is a 2 minute spin cycle, followed by two 2-minute rinse cycles using 8 gpg water at a temperature of 77° F. (25° C.).

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7L^2-40Lb)/700$$

The higher the value for W, the better the whiteness performance in the above test, fabrics exposed to the bleaching system display significantly improved whiteness after laundering compared with fabrics which have not been exposed to the bleaching system of the invention.

EXAMPLE V

A laundry bar suitable for hand-washing soiled fabrics is prepared comprising the following ingredients.

| Component | Weight % |
|---|---|
| $C_{12}$ linear alkyl benzene sulfonate | 30 |
| Phopshate (as sodium tripolyphosphate) | 7 |
| Sodium carbonate | 25 |
| Sodium pyrophosphate | 7 |
| Coconut monoethanolamide | 2 |
| Zeolite A (0.1–10 microns) | 5 |
| Carboxymethylcellulose | 0.2 |
| Polyacrylate (m.w. 1400) | 0.2 |
| Nonanoyl caprolactam | 5 |
| Brightener, perfume | 0.2 |
| Protease | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

The detergent laundry bars are processed in conventional soap or detergent bar making equipment as commonly used in the art. Testing is conducted following the methods used in Example IV. In the test, fabrics exposed to the bleaching system display significantly improved whiteness after laundering compared with fabrics which have not been exposed to the bleaching system of the invention.

EXAMPLE VI

A laundry bar is prepared by a procedure identical to that of Example V, with the single exception that 20% of a 1:1:1 mixture of octanoyl caprolactam, nonanoyl caprolactam, and decanoyl caprolactam is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE VII

A laundry bar is prepared by a procedure identical to that of Example V, with the single exception that 15% of a 1:1 mixture of nonanoyl caprolactam and tetraacetyl ethylene diamine (TAED) is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE VIII

A laundry bar is prepared by a procedure identical to that of Example V, with the single exception that an equivalent amount of benzoyl caprolactam is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE IX

A laundry bar is prepared by a procedure identical to that of Example V, with the single exception that 6% of a 1:1 mixture of benzoyl caprolactam and tetraacetyl ethylene diamine is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE X

A laundry bar is prepared by a procedure identical to that of Example V, with the single exception that 6% of a 1:1 mixture of benzoyl caprolactam and a benzoxazin-type bleach activator, as disclosed in U.S. Pat. No. 4,966,723, is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE XI

A bleaching system is prepared comprising the following ingredients.

| Component | Weight % |
|---|---|
| Nonanoyl caprolactam | 15 |
| Sodium percarbonate | 25 |
| Chelant (ethylenediamine disuccinate, EDDS) | 10 |
| Filler* and water | Balance to 100% |

*Can be selected from convenient materials such as $CaCO_3$, talc, clay, silicates, and the like.

Testing is conducted following the methods used in Example IV with the single exception that the an equivalent amount of the above bleaching system is substituted for the detergent composition used in Example IV. In the test, fabrics exposed to the bleaching system display significantly improved whiteness after laundering compared with fabrics which have not been exposed to the bleaching system of the invention.

While the compositions and processes of the present invention are especially useful in hand-wash fabric laundering operations, it is to be understood that they are also useful in any cleaning system which involves low water:fabric ratios. One such system is disclosed in U.S. Pat. No. 4,489,455, Spendel, issued Dec. 25, 1984, which involves a washing machine apparatus which contacts fabrics with wash water containing detersive ingredients using a low water: fabric ratio rather than the conventional method of immersing fabrics in an aqueous bath. The compositions herein provide excellent bleaching performance in such mechanical systems. Typically, the ratio of water:fabric ranges from about 0.5:1 to about 6:1 (liters of water:kg of fabric).

EXAMPLE XII

Using the machine and operating conditions disclosed in U.S. Pat. No. 4,489,455, cited above, 25 grams of a composition according to Example IV herein are used to launder fabrics with concurrent bleaching. If desired, sudsing of the composition can be minimized by incorporating therein from 0.2% to 2% by weight of a fatty acid, secondary alcohol, or silicone suds controlling ingredient. In the test, fabrics exposed to the bleaching system display significantly improved whiteness after laundering compared with fabrics which have not been exposed to the bleaching system of the invention.

Contrary to the teachings of U.S. Pat. No. 4,545,784, cited above, the bleach activator is preferably not absorbed onto the peroxygen bleaching compound. To do so in the presence of other organic detersive ingredients could cause safety problems. It has now been discovered that the caprolactam bleach activators of this invention can be dry-mixed with peroxygen bleaching compounds, especially perborate, and thereby avoid potential safety problems.

EXAMPLE XIII

A laundry bar suitable for hand-washing soiled fabrics is prepared comprising the following ingredients.

| Component | Weight % |
|---|---|
| Linear alkyl benzene sulfonate | 30 |
| Phosphate (as sodium tripolyphosphate) | 7 |
| Sodium carbonate | 25 |
| Sodium pyrophosphate | 7 |
| Coconut monoethanolamide | 2 |
| Zeolite A (0.1–10 microns) | 5 |
| Carboxymethylcellulose | 0.2 |
| Polyacrylate (m.w. 1400) | 0.2 |
| Benzoyl caprolactam | 5 |
| Sodium perborate tetrahydrate | 5 |
| Brightener, perfume | 0.2 |
| Protease | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

The detergent laundry bars are processed in conventional soap or detergent bar making equipment as commonly used in the art with the bleaching activator dry-mixed with the perborate bleaching compound and not affixed to the surface of the perborate. Testing is conducted following the methods used in Example III. In the test, fabrics exposed to the bleaching system of this invention display significantly improved whiteness after laundering compared with fabrics which have not been exposed to the bleaching system of the invention.

EXAMPLE XIV

A laundry bar is prepared by a procedure identical to that of Example XIII, with the exceptions that 15% of a 1:1 mixture of nonanoyl caprolactam and tetraacetyl ethylene diamine (TAED) is substituted for the benzoyl caprolactam bleach activator, the amount of sodium perborate tetrahydrate is 25%, the amount of linear alkyl benzene sulfate is 20%, and the amount of sodium carbonate is 12. The laundering method of Example III is repeated. In the test, all fabrics exposed to the bleaching system of this invention display significantly improved whiteness after laundering compared with fabrics which have not been exposed to the bleaching system of the invention.

EXAMPLE XV

A laundry bar is prepared by a procedure identical to that of Example XIII, with the exceptions that an equivalent amount of nonanoyl caprolactam is substituted for the benzoyl caprolactam bleach activator, the amount of sodium perborate tetrahydrate is 14%, and the amount of phosphate and sodium pyrophosphate is The laundering method of Example III is repeated. In the test, all fabrics exposed to the bleaching system of this invention display significantly improved whiteness after laundering compared with fabrics which have not been exposed to the bleaching system of the invention.

EXAMPLE XVI

A laundry bar is prepared by a procedure identical to that of Example XIII, with the exceptions that 6% of a 1:1 mixture of benzoyl caprolactam and tetraacetyl ethylene diamine is substituted for the benzoyl caprolactam bleach activator, the amount of sodium perborate tetrahydrate is 12%, and the amount of phosphate and pyrophosphate is 0%. The laundering method of Example IV is repeated. In the test, all fabrics display significantly improved whiteness after laundering compared with fabrics which have not been exposed to the bleaching system of the invention.

EXAMPLE XVII

A laundry bar is prepared by a procedure identical to that of Example XIII, with the exceptions that 6% of a 1:1 mixture of benzoyl caprolactam and a benzoxazin-type bleach activator, as disclosed in U.S. Pat. No. 4,966,723, is substituted for the benzoyl caprolactam bleach activator, the amount of sodium perborate tetrahydrate is 18% and the amount of phosphate and pyrophosphate is 0%. The laundering method of Example IV is repeated. In the test, all fabrics display significantly improved whiteness after laundering compared with fabrics which have not been exposed to the bleaching system of the invention.

EXAMPLE XVIII

A laundry bar is prepared by a procedure identical to that of Example XIII, with the single exception that 6% of a 1:1 mixture of benzoyl caprolactam and a bleach activator, as disclosed in U.S. Pat. No. 4,634,551, cited above, is substituted for the benzoyl caprolactam bleach activator. The laundering method of Example IV is repeated. In the test, all fabrics display significantly improved whiteness after laundering compared with fabrics which have not been exposed to the bleaching system of the invention.

EXAMPLE XIX

A granular detergent composition is prepared comprising the following ingredients.

| Component | Weight % |
|---|---|
| Linear alkyl benzene sulfonate | 22 |
| Phosphate (as sodium tripolyphosphate) | 20 |
| Sodium carbonate | 14 |
| Sodium silicate | 3 |
| Sodium perborate tetrahydrate | 15 |
| Ethylenediamine disuccinate chelant (EDDS) | 0.4 |
| Sodium sulfate | 5.5 |
| Nonanoyl caprolactam | 5 |
| Minors, filler** and water | Balance to 100% |

**Can be selected from convenient materials such as $CaCO_3$, talc, clay, silicates, and the like.

Aqueous crutcher mixes of heat and alkali stable components of the detergent compositions are prepared and spray-dried. The other ingredients, including the bleach activator, are dry-mixed so that the detergent composition contains the ingredients tabulated at the levels shown.

Testing is conducted following the methods used in Example IV. In the test, fabrics exposed to the bleaching system display significantly improved whiteness after laundering compared with fabrics which have not been exposed to the bleaching system of the invention.

EXAMPLE XX

A granular detergent composition is prepared by a procedure identical to that of Example XIX, with the exceptions that 15% of a 1:1 mixture of nonanoyl caprolactam and tetraacetyl ethylene diamine (TAED) is substituted for the nonanoyl caprolactam bleach activator, 25%, the amount of phosphate is 16%, and the amount of pyrophosphate is 0%. The laundering method of Example IV is repeated. In the test, all fabrics display significantly improved whiteness after laundering compared with fabrics which have not been exposed to the bleaching system of the invention.

EXAMPLE XXI

A granular detergent composition is prepared by a procedure identical to that of Example XIX, with the exception that an equivalent amount of benzoyl caprolactam is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE XXII

A granular detergent composition is prepared by a procedure identical to that of Example XIX, with the exceptions that 10% of a 1:1 mixture of benzoyl caprolactam and tetraacetyl ethylene diamine is substituted for the nonanoyl caprolactam bleach activator and 10% sodium percarbonate is substituted for the sodium perborate tetrahydrate. The laundering method of Example IV is repeated. In the test, all fabrics display significantly improved whiteness after laundering compared with fabrics which have not been exposed to the bleaching system of the invention.

EXAMPLE XXIII

A granular detergent composition is prepared by a procedure identical to that of Example XIX, with the single exception that 6% of a 1:1 mixture of benzoyl caprolactam and a benzoxazin-type bleach activator, as disclosed in U.S. Pat. No. 4,966,723, is substituted for the nonanoyl caprolactam bleach activator. The laundering method of Example IV is repeated. In the test, all fabrics display significantly improved whiteness after laundering compared with fabrics which have not been exposed to the bleaching system of the invention.

EXAMPLE XXIV

A granular detergent composition is prepared by a procedure identical to that of Example XIX, with the single exception that 6%. of a 1:1 mixture of nonanoyl caprolactam and a bleach activator, as disclosed in U.S. Pat. No. 4,634,551, cited above, is substituted for the nonanoyl caprolactam bleach activator. The laundering method of Example III is repeated. In the test, all fabrics exposed to the bleaching system of this invention display significantly improved whiteness after laundering compared with fabrics which have not been exposed to the bleaching system of the invention.

What is claimed is:

1. A method for cleaning fabrics in water comprising contacting said fabrics in an aqueous liquor comprising a detergent composition which comprises from about 900 ppm to about 20,000 ppm of conventional detergent ingredients and a bleaching system which comprises:

a) at least about 0.1%, weight, of a peroxygen bleaching compound capable of yielding hydrogen peroxide in an aqueous solution; and b) at least about 0.1% by weight, of a bleach activator selected from the group consisting of octanoyl caprolactam, nonanoyl caprolactam decanoyl caprolactam, undecanoyl caprolactam, 3,5,5-trimethylhexanoyl caprolactam, and mixtures thereof;

wherein the fabric:water ratio is in the range of from about 1 kg:10 liters to about 1 kg:0.5 liters and the weight ratio of bleach activator to peroxygen bleaching compound is in the range of from about 2:1 to about 1:5.

2. A method according to claim 1 which comprises hand-washing said fabrics.

3. A hand-washing method according to claim 2 wherein the conventional detergent ingredients comprise from about 5% to about 80% by weight of a detersive surfactant.

4. A hand-washing method according to claim 3 wherein the conventional detergent ingredients also comprise from about 5% to about 80% by weight of a detergent builder and from 0% to about 20% by weight of conventional detersive adjunct materials.

5. A method according to claim 1 wherein the peroxygen bleaching compound is selected from the group consisting of sodium perborate monohydrate, sodium perborate tetrahydrate, sodium pyrophosphate peroxyhydrate, urea peroxyhydrate, sodium percarbonate, sodium peroxide and mixtures thereof.

* * * * *